United States Patent [19]

Kelly

[11] 4,197,675

[45] Apr. 15, 1980

[54] SENSING SYSTEM FOR AUTOMATICALLY OPENING GARAGE DOORS

[76] Inventor: Edward Kelly, 106 Nottinghill La., Trenton, N.J. 08619

[21] Appl. No.: 890,741

[22] Filed: Mar. 27, 1978

[51] Int. Cl.[2] ..... E05F 15/20

[52] U.S. Cl. ..... 49/31; 340/634; 49/199

[58] Field of Search ..... 49/2, 29, 30, 31, 199; 340/632–634, 528

[56] References Cited

U.S. PATENT DOCUMENTS

| | | | |
|---|---|---|---|
| 2,902,276 | 9/1959 | Purdy | 49/30 X |
| 3,631,436 | 12/1971 | Taguchi | 340/528 |
| 3,786,462 | 1/1974 | Hayden | 340/634 |
| 3,886,535 | 5/1975 | Cirincione | 340/634 X |

FOREIGN PATENT DOCUMENTS

| | | | |
|---|---|---|---|
| 1057063 | 2/1967 | United Kingdom | 49/30 |

*Primary Examiner*—Kenneth Downey

*Attorney, Agent, or Firm*—John J. Kane; Frederick A. Zoda; Albert Sperry

[57] ABSTRACT

A sensing system for use in a garage or other similar enclosure having an automatic door operator for automatically opening a garage door responsive to a lack of sufficient oxygen therein including a gas detector located within the enclosure responsive to actuate a detection relay which in turn will close a normally open detection switch, the closing of the detection switch will normally cause operation of the door operator to allow oxygen to enter into the enclosure through the door opening, the detection switch being located in a door opening control circuit which includes therein a first limit switch which is open whenever the door is open in order to prevent actuation of the door operator when the door is already open, the door opening control circuit also including a delay clock and delay switch which will be normally closed to allow operation of the door operator, this system also including a time delay circuit with a second limit switch therein which is adapted to be normally open and to close only when the door is open, in this manner the second limit switch which will close when the door opens will cause actuation of the delay clock which will open the delay switch to prevent operation of the door opener for 5 minutes after the door has been opened and then closed, this system may also include a sensing lamp to be lighted whenever the gas detector is actively monitoring and also to alternatively include a detection indicator lamp which is adapted to be lighted responsive to the emitting of an electrical signal by the gas detector, the door opening control circuit in this configuration will cause opening of the door by actuation of the door operator whenever the gas detection means senses a low level of oxygen in the environment of the enclosure assuming that the door is not already in the open position.

11 Claims, 2 Drawing Figures

SENSING SYSTEM FOR AUTOMATICALLY OPENING GARAGE DOORS

BACKGROUND OF THE INVENTION

1. Field of the Invention

The present invention deals with the field of alarms and sensing systems for noting an excess amount of carbon monoxide or a low amount of oxygen with any closed environment. With the widespread use of automatic garage door openers a problem has arisen concerning some owners who will mistakenly warm up the engines of motor vehicles within garages wherein the door operators are closed. In this manner a lethal environment can be created within a closed chamber adjacent a dwelling or the like.

The present system provides the means for sensing the lack of oxygen or an excess amount of carbon monoxide within a garage in order to automatically open a garage door. Such sensing devices have problems heretofore untreated such as when a car is started and the door is immediately opened sometimes an amount of carbon monoxide can travel in the area of the sensor which will cause the door to immediately open once it is closed after the driver has left the location which will allow the door to remain open throughout the day until the driver returns. This problem is overcome by the present invention by the use of a delay clock. Whenever the door is opened a limit switch will sense this opening action and initiate the five minute delay clock which will prevent opening of the door by the gas detection means for five minutes after any door opening operation. Therefore any fumes which have gathered in the area of the gas detection means when a driver backs his car out of the garage and then closes the door will not cause the door to be instantly opened but will delay for five minutes and only at the end of the five minute time period will the door be caused to open if the carbon monoxide is still localized in the area of the gas detection means.

2. Description of the Prior Art

Various emergency gas alarms and sensing systems are shown in the prior art such as U.S. Pat. Nos. 3,641,541; 3,757,471; 3,777,423; and 3,908,309. These condition-responsive sensing systems do not suggest usage with an automatic door opener which is the particular application of the present invention.

U.S. Pat. No. 3,908,309 does show a system for sensing the products of combustion for responsively controlling door entries into the chamber. However, none of the prior art suggests or appreciates the problems created by automatic sensing systems usable with automatic door operator devices.

SUMMARY OF THE INVENTION

The present invention provides a sensing system for use in a garage or similar enclosure having an automatic door operator. The present system provides a means for automatically opening the garage door responsive to the lack of a sufficient amount of oxygen within the internal environment thereof.

The present system includes a door opening control circuit and a time delay circuit. The door opening control circuit is responsive to a predetermined gas condition to initiate operation of the door opener. The door opening control circuit includes a first limit switch therein which will prevent actuation of the door operator such that the gas detector can only trigger operation of the automatic door operator when the door is in the closed position. The first limit switch will remain open unless the door is in the closed position. The door opening control circuit means also includes a detection switch means therein.

The detection switch means is normally open, however, it is responsive to close whenever the gas detection means senses a dangerous environmental condition. The gas detection means is in electrical communication with a detection relay means. Whenever the gas detection means senses a dangerous gaseous condition such as a lack of sufficient amount of oxygen within the internal environment of the garage the gas detection means will emit an electrical signal which will activate the detection relay means which will in turn close the detection switch means and cause operation of the door opening control circuit means. In this manner the gas detection means will directly control operation and opening of the door operator.

The time delay circuit means provides a means for inhibiting operation of the door opening control circuit means for a predetermined period of time after an opening and closing operation of the door. A problem exists with respect to such gas monitoring systems since normally a person will open the door and immediately thereafter start the automobile. The automobile will then be moved out of the garage and the door will be closed and the person will leave the immediate area of the garage. Often the short time during which the automobile is operating will cause a localization of carbon monoxide which may be gathered in the immediate area of the gas detection means. It might take 30 seconds or 60 seconds in order for this localization of carbon monoxide to distribute or diffuse equally throughout the garage environment and therefore this localization of carbon monoxide really presents no danger. However as soon as the door closes the gas detection means will sense this over abundance of carbon monoxide or the lack of oxygen and will immediately activate the detection relay means which will close the detection switch means and call for operation of the door opener. If this is allowed to happen the door will open and remain open throughout the day after the person driving the automobile has left the immediate area of the garage.

To prevent this type of improper opening a time delay circuit means is included in the present system. The time delay circuit means includes a second limit switch and a clock initiation means. The second limit switch is adapted to be normally open and will close whenever the door is opened. Thus as soon as a door is opened the second limit switch will close which will cause activation of the clock initiation means as soon as the door is thereafter closed and the delay clock means will then immediately open the delay switch means. This will inhibit activation of the door opening control circuit means which would normally be caused by closing of the detection switch means. The delay clock means can be chosen with any predetermined delay. But five minutes is preferably the time period. Once the five minute or other time delay has elapsed the delay clock means will close the delay switch means and if a dangerous gas condition still exists the gas detection means will activate the detection relay means and close the detection switch means and cause opening of the door by actuation of the door operator at the end of the five minute period.

The system may preferably include a sensing lamp which will indicate that the gas detector is actively monitoring the environment within the enclosure. Also another light may be included to act as a detection indicator lamp which will become lighted whenever a dangerous gaseous condition is sensed by the gas detection means.

It is an object of the present invention to provide a means for detecting a dangerous gaseous condition within a garage environment.

It is an object of the present invention to provide a sensing system usable in combination with an automatic garage door opener for causing opening of the garage door whenever a dangerous gaseous condition is sensed within the garage.

It is an object of the present invention to provide a means for sensing a lack of oxygen within a garage having a garage door controlled by an automatic garage door opener.

It is an object of the present invention to provide a means of sensing an excess amount of carbon monoxide within a garage environment which includes an automatically controlled garage door.

It is an object of the present invention to provide a means for delaying the activation of a gas detection means for a period of time after the opening of the garage door by the automatic opening device.

It is an object of the present invention to provide a sensing system for use in a garage or other similar enclosure having an automatic door operator for automatically opening the garage door responsive to a predetermined gaseous condition therein.

It is an object of the present invention to provide an automatic garage door opener for opening the door of a garage which is only operable whenever the door is already located in the closed position.

It is an object of the present invention to provide a means for automatically opening a garage door whenever a lack of oxygen exists within the internal environment of the garage wherein the garage door will remain open until manually or automatically closed.

It is an object of the present invention to provide a garage gas detection system which includes a sensing lamp to show the condition of continual monitoring of the environment.

It is an object of the present invention to provide a sensing system which includes a lamp which when lighted indicates a dangerous gaseous condition within the environment.

It is an object of the present invention to provide a sensing system for automatically opening garage doors which is inexpensive to install and efficient in operation.

It is an object of the present invention to provide a sensing system for use with an automatic garage door system which can be easily and efficiently and with limited expense added to an existing garage door installation.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
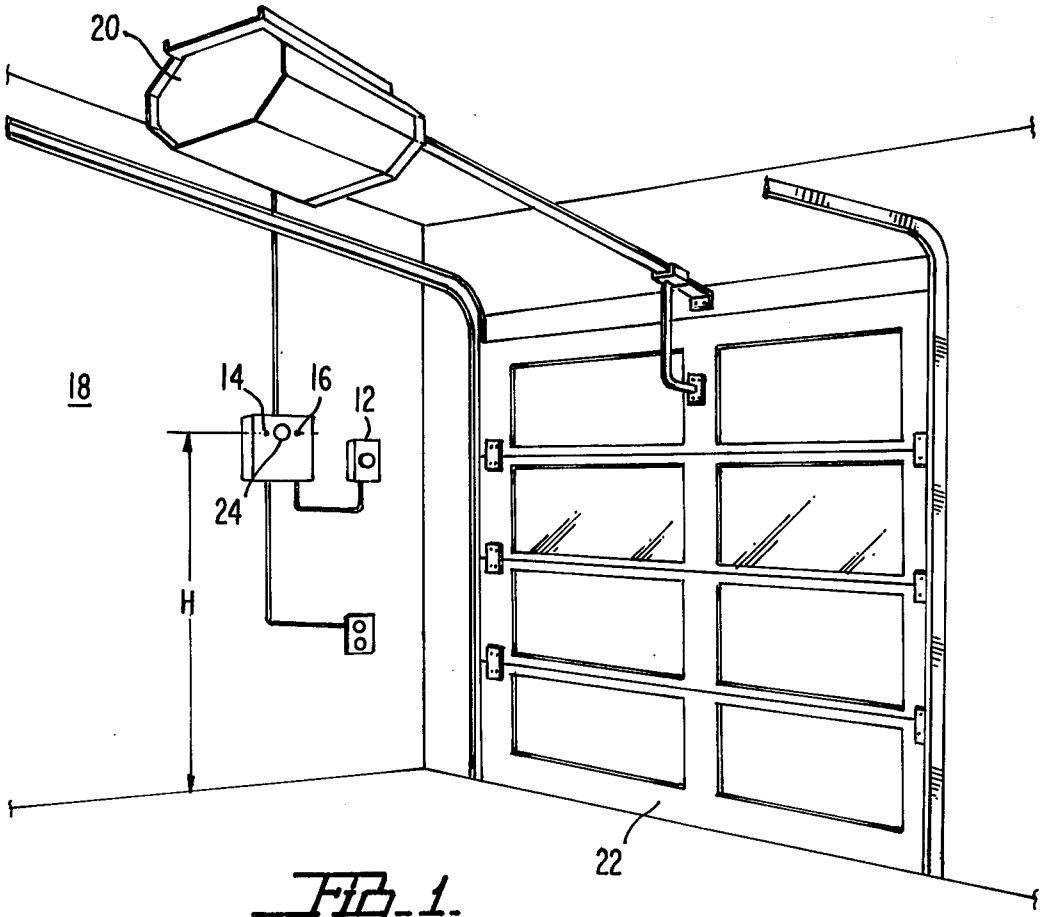
FIG. 1 shows a schematic view of the sensing system of the present invention and an automatic garage door opener in position within a garage environment.

The sensing system of the present invention may be basically positioned within a gas detection control box 10 as shown in FIG. 1. The control box may include a gas detection means 24 located therein as well as possibly a sensing lamp 14 and a detection indicator lamp 16. Sensing lamp 14 will note whenever power is being applied to the gas detection means and therefore will sense whether the gas detection means is sensing and the detection indicator lamp 16 will be lighted whenever a dangerous gaseous condition exists within the garage 18.

FIG. 1 shows the door operator 20 secured to the ceiling of the garage 18 and to the garage door 22. In order to induce manual operation of the door operator 20 a manual operation box 12 is included with a push button thereon to facilitate operation.

The gas detection control box 10 should preferably be located approximately 4 feet from the garage door opening and a height of approximately 54 inches. In this manner the accurate sensing of any accumulation of carbon monoxide or a lack of oxygen within the environment of garage 18 can be most effectively sensed.

Figure 2:
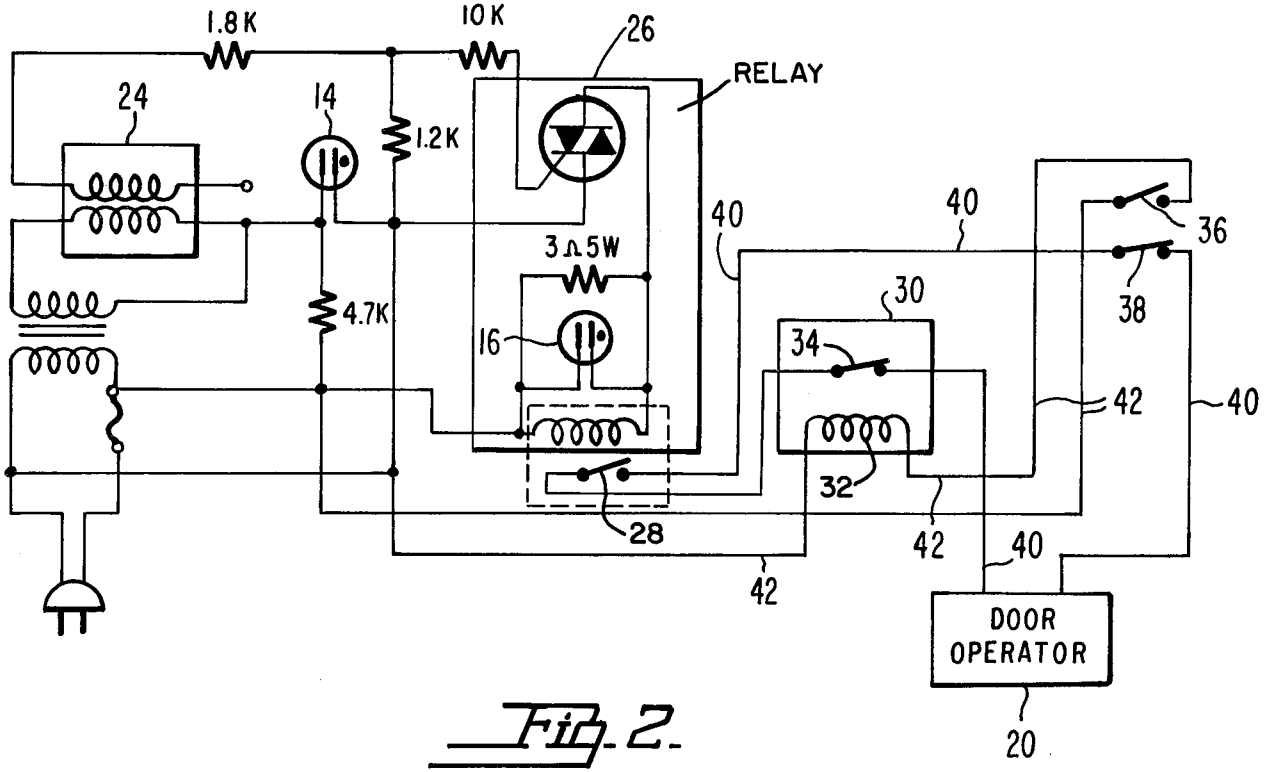
FIG. 2 is an electrical schematic diagram showing the circuitry usable for the door opening control circuit and the time delay circuit.

FIG. 2 illustrates an electrical schematic drawing of the presently discussed preferred embodiment. The basic operator circuit or door opening circuit means 40 includes a group of elements therein in series connection. The door opening control circuit means 40 is connected to the door operator 20 to cause actuation thereof whenever an alarm condition is sensed by the gas detection means 24 within the garage 18. The gas detection means 24 may be of a variety of configurations. Preferably detection means 24 senses a lack of oxygen within the environment of the garage. Alternatively if cost considerations necessitate a carbon monoxide or other dangerous gaseous sensing means can be utilized as the gas detection means 24. However whenever an alarm condition is sensed by the gas detection means 24 an electrical signal will be admitted therefrom to the detection relay means 26. The detection relay means will then be turned on and will close the normally opened detection switch means 28. The closing of this switch 28 will under normal conditions cause actuation of the operator 20 by closing the door opener control circuit means 40 and thereby apply approximately 24 volts of alternating current to the door operator. The door will then open and the gas which caused the alarm condition will be dissipated into the external environment.

The door opening control circuit means 40 also includes therein a first switch means 38 such as a limit switch. This switch can be adapted to be open only when the garage door itself is open. And therefore the switch 38 will be closed whenever the door is closed. In this manner the door opening control circuit means 40 will not be able to communicate a dangerous gaseous condition to the door operator whenever the door is already in the opened position. Obviously there is no desire to actuate the door opener when the door is already in the opened position therefore the first limit switch means 38 prevents the gas detection means 24 from initiating operation of the door operator 20 whenever the garage door is already in the opened position.

The door opening control circuit means 40 also includes therein a delay switch means 34 which is normally closed. Delay switch means 34 is operatively connected to a delay clock means 30. Whenever the delay clock means is operating in the delay time cycle the delay switch means 34 will be open and thereby will prevent the actuation of door operator 20 by closing of detection switch means 28.

The sensing lamp 14 is shown positioned within the circuitry adjacent the gas detection means 24 and as such will be lighted whenever the gas detection means 24 is actively monitoring the environment within the garage 18. Also within the detection relay means a detection indicator lamp 16 may be located in order to be lighted whenever a dangerous gaseous condition has been sensed within the garage environment. Each of these lamps are optional additions to the systems disclosed herein.

During normal operation such as in the morning a person will simultaneously start an automobile located within the garage while opening the garage door. This operation may cause a localized amount of carbon monoxide or a localized lack of oxygen in the immediate area adjacent the gas detection means 24. This condition will be very short lived since the other gases within the garage will mix and dissipate the dangerous gaseous conditions temporarily located adjacent the gas detection means. When such a localization exists a person will normally back the car out of the garage and drive away while pushing the button within the car which is operable to close the garage door. As soon as the door closes the first limit switch means 38 will close and since the detection switch means 28 is already closed through the sensing by gas detection means 24 of a dangerous gaseous condition the door opening control circuit 40 will cause immediate operation of the door opener 20. Therefore as soon as the door closes it will immediately open up and remain open until closed by a manual operator. This condition will often exist in the morning when a person leaves the garage to drive to work and as such a garage door could remain open all day long if this condition were to exist. Therefore in order to eliminate this possible malfunction a time delay circuit means 42 is included in the present invention.

Time delay circuit means 42 includes a clock initiation means 32 and a limit switch 36 therein. Whenever the normally open limit switch 36 is closed the clock initiation means 32 will be activated such that subsequent closing will cause initiation of the time period of the delay clock means 30. During this period of time which will normally be approximately 5 minutes the delay clock means 30 will maintain the delay switch means 34 continually in an opened position and thereby inhibit operation of the door operator 20 by the gas detection means 24. The clock initiation means 32 will be activated whenever switch 36 is closed. Switch 36 will only be closed when the garage door is opened. At all other times the second switch means 36 will be maintained in the opened position.

During operation as soon as the garage door is opened normally the second switch means 36 will close. Hence the clock initiation means 32 will be activated and the 5 minute delay clock period will be initiated as soon as the door is thereafter closed. Therefore for the 5 minute time period the gas detection means 24 will be incapable of actuating the door operator. Translated into the previously described situation, in the morning when a person starts his car and opens the garage door immediately limit switch 36 will close causing initiation of the delay clock 5 minute time period. The person will then back his car out of the garage and close the garage door and drive away. For 5 minutes after the opening and closing operation the gas detection means 24 is incapable of opening the door operator 20 due to the fact that the delay clock means 30 is holding the delay switch means 34 in an opened position. Therefore even though the doors close and the first limit switch 38 is closed and the detection switch means 28 is closed the opened condition of the delay switch means 34 will prevent operation of the door operator 20 due to the sensing by the gas detection means 24 of an alarm gaseous condition. This circumstance is desired because the gas detection means 24 will often sense a false alarm condition since carbon monoxide or gas having a lack of oxygen therein may be only temporarily in the immediate neighborhood of the gas detection control box 10 and as such not truly present a dangerous condition. It is assumed that within 5 minutes or whatever other time period is chosen the gas which caused the false alarm condition will dissipate and the gas detection means 24 will be rendered into an off condition and thereby open the detection switch means 28 and resume normal sensing at the end of the 5 minute time period of the delay clock means.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A sensing system for use in a garage or other similar enclosure having an automatic door operator for automatically opening a garage door responsive to a lack of sufficient oxygen therein comprising:

(a) a gas detection means located within the enclosure and responsive to the presence of below a predetermined minimum amount of oxygen to emit an electrical signal;

(b) a detection relay means in electrical communication with said gas detection means and adapted to be actuated upon receiving an electrical signal generated from said gas detection means;

(c) a normally open detection switch means in electrical communication with said detection relay means and adapted to close responsive to actuation of said detection relay means;

(d) a door opening control circuit means electrically connected to the automatic door opener to cause operation thereof for opening a door into the enclosure, said door opening control circuit means including therein said normally open detection switch means and:

(1) a first switch means adapted to be open responsive to the door being opened and adapted to be closed responsive to the door being in a closed position in order to allow operation of said automatic door opener only when the door is in the closed position; and (2) a delay clock means including a delay switch means being normally closed to allow operation of the automatic door opener unless said delay clock means is operating; and (e) a time delay circuit means including;
(1) a second switch means being normally open and adapted to close responsive to opening of the door; and
(2) a clock initiation means electrically connected to said delay clock means to cause actuation thereof and thus opening of said delay switch means for a predetermined period of time responsive to closing of said second switch means caused by opening and subsequent closing of the door.

2. The system as defined in claim 1 wherein said gas detection means is located approximately 54 inches above ground level.

3. The system as defined in claim 1 wherein said first switch means is a limit switch adapted to be closed only when the door is closed.

4. The system as defined in claim 1 wherein said normally open second switch means is a limit switch adapted to be closed responsive to the door being opened.

5. The system as defined in claim 1 further including a detection indicator lamp adapted to be lit responsive to the emitting of an electrical signal by said gas detection means.

6. The system as defined in claim 1 wherein said delayed clock means upon actuation of said clock initiation means is adapted to open said delay switch means and thus render said door opening control circuit means inoperative for approximately a 5 minute period of time after which said delay clock means will allow said delay switch means to revert to the normally closed position to allow said door opening control circuit means to be rendered again operative.

7. The system as defined in claim 1 wherein said delay switch means, said detection switch means and said first switch means are electrically in series with said door operator within said door opening control circuit means.

8. The system as defined in claim 1 wherein said clock initiation means and said second switch means are electrically in series within said time delay circuit means.

9. The system as defined in claim 1 wherein said gas detection means is responsive to a predetermined high level of carbon monoxide to emit an electrical signal.

10. A system as defined in claim 1 including a sensing lamp operative to be lighted whenever said gas detection means is actively monitoring the environment within the enclosure.

11. A sensing system for use in a garage or other similar enclosure having an automatic door operator for automatically opening a garage door responsive to a lack of sufficient oxygen therein comprising:

(a) a gas detection means located within the enclosure and responsive to the presence of below a predetermined minimum amount of oxygen to emit an electrical signal;
(b) a detection relay means in electrical communication with said gas detection means and adapted to be actuated upon receiving an electrical signal generated from said gas detection means;
(c) a normally open detection switch means in electrical communication with said detection relay means, and adapted to close responsive to actuation of said detection relay means;
(d) a door opening control circuit means electrically connected to the automatic door opener to cause operation thereof for opening a door into the enclosure, said door opening control circuit means including electrically in series therein said normally open detection switch means and:
(1) a first limit switch means adapted to be opened responsive to the door being open and responsive to be closed responsive to the door being closed in order to allow operation of said automatic door opener only when the door is in the closed position; and
(2) a delay clock means including a delay switch means being normally closed to allow operation of the automatic door opener unless said delay clock means is operating; and
(e) a time delay circuit means including electrically in series:
(1) a second limit switch means being normally open and adapted to close responsive to opening of the door; and
(2) a clock initiation means electrically connected to said delay clock means to cause actuation thereof and thus opening of said delay switch means for a predetermined period of time responsive to closing of said second limit switch means caused by opening and subsequent closing of the door, said delay clock means upon actuation of said clock initiation means being adapted to open said delay switch means and thus render said door opening control circuit means inoperative for approximately a 5 minute period of time after which said delay clock means will allow said delay switch means to revert to the normally closed position to allow said door opening control circuit means to be rendered again operative; and
(f) a detection indicator lamp adapted to be lit responsive to the emitting of an electrical signal by said gas detection means.

* * * * *